US005336426A

United States Patent [19]

Rader et al.

[11] Patent Number: 5,336,426

[45] Date of Patent: Aug. 9, 1994

[54] PHASE STABLE VISCOELASTIC CLEANING COMPOSITIONS

[76] Inventors: James E. Rader, 1781 Beachwood Way; William L. Smith, 3227 Runnymede Ct., both of Pleasanton, Calif. 94566

[21] Appl. No.: 729,664

[22] Filed: Jul. 15, 1991

Related U.S. Application Data

[63] Continuation-in-part of Ser. No. 121,549, Nov. 17, 1987, Pat. No. 5,055,219.

[51] Int. Cl.[5] ..... C11D 7/54

[52] U.S. Cl. ..... 252/102; 252/110; 252/118; 252/542; 252/547

[58] Field of Search ..... 252/102, 110, 118, 542, 252/547

[56] References Cited

U.S. PATENT DOCUMENTS

| | | | |
|---|---|---|---|
| 4,800,036 | 1/1989 | Rose et al. | 252/102 |
| 4,842,771 | 6/1989 | Rörig et al. | 252/547 |
| 4,853,146 | 8/1989 | Rörig et al. | 252/142 |
| 4,900,467 | 2/1990 | Smith | 252/95 |
| 5,041,239 | 8/1991 | Rörig et al. | 252/315.1 |
| 5,055,219 | 10/1991 | Smith | 252/102 |
| 5,057,246 | 10/1991 | Bertho et al. | 252/545 |
| 5,078,896 | 1/1992 | Rörig et al. | 252/102 |

*Primary Examiner*—Gary P. Straub
*Assistant Examiner*—Timothy C. Vanoy
*Attorney, Agent, or Firm*—John A. Bucher; Michael J. Mazza

[57] ABSTRACT

A thickened aqueous cleaning composition is viscoelastic, and has utility as a drain opening composition or as a hard surface cleaner having a cleaning-effective residence time on non-horizontal surfaces. In one embodiment the composition comprises a cleaning active, a quaternary ammonium compound, and an organic counterion. In another embodiment, the viscoelastic quality of the composition is advantageously utilized as a drain opener which rapidly penetrates standing water with minimal dilution to deliver active to the clog material. In these embodiments and corresponding methods of use, a free amine is limited with respect to the amount of the quaternary ammonium compound in the composition in order to maintain phase stability and to achieve further enhanced rheological and aesthetic properties in the composition.

12 Claims, 2 Drawing Sheets

PHASE STABLE VISCOELASTIC CLEANING COMPOSITIONS

This is a continuation-in-part of application Ser. No. 121,549, which issued on Oct. 8, 1991 as U.S. Pat. No. 5,055,219entitled "Viscoelastic Cleaning Compositions and Methods of Use Therefor", filed on Nov. 17, 1987 by William L. Smith under assignment to the assignee of the present invention.

BACKGROUND OF THE INVENTION

1. Field of The Invention

The present invention relates to thickened cleaning compositions having a viscoelastic rheology, and in particular to such viscoelastic cleaning compositions and methods of use having improved phase and rheological stability.

2. Description of Related Art

Much art has addressed the problem of developing a thickened cleaning composition, which may contain a bleach and may have utility as a hard surface cleanser. The efficacy of such compositions is greatly improved by viscous formulations, increasing the residence time of the cleaner. Splashing during application and use is minimized, and consumer preference for a thick product is well documented. Schilp, U.S. Pat. No. 4,337,163 shows a hypochlorite thickened with an amine oxide or a quaternary ammonium compound, and a saturated fatty acid soap. Stoddart, U.S. Pat. No. 4,576,728 shows a thickened hypochlorite including 3- or 4-chlorobenzoic acid, 4-bromobenzoic acid, 4-toluic acid and 3-nitrobenzoic acid in combination with an amine oxide. DeSimone, U.S. Pat. No. 4,113,645 discloses a method for dispersing a perfume in hypochlorite using a quaternary ammonium compound. Bentham, et al., U.S. Pat. No. 4,399,050, discloses hypochlorite thickened with certain carboxylated surfactants, amine oxides and quaternary ammonium compounds. Jeffrey, et al., GB 1466560 shows bleach with a soap, surfactants and a quaternary ammonium compound. For various reasons, the prior an thickened hypochlorite compositions are not commercially viable. In many instances, thickening is insufficient to provide the desired residence time on non-horizontal surfaces. Adding components, and/or modifying characteristics of dissolved components often creates additional problems with the composition, such as syneresis, which require adding further components in an attempt to correct these problems. Polymer thickened hypochlorite bleaching compositions tend to be oxidized by the hypochlorite. Prior art thickened bleach products generally exhibit phase instability at elevated (above about 100° F.) and/or low (below about 35° F.) storage temperatures. Difficulties exist with colloidal thickening agents in that these tend to exhibit either false-bodied or thixotropic rheologies, which, at high viscosities, can result in a tendency to set up or harden. Other hypochlorite compositions of the prior art are thickened with surfactants and may exhibit hypochlorite stability problems. Surfactant thickening systems also are not cost effective when used at the levels necessary to obtain desired product viscosity values. European Patent Application 0,204,479 to Stoddard describes shear-thinning compositions, and seeks to avoid viscoelasticity in such shear-thinning compositions.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Such compositions are exemplified by U.S. Pat. Nos. 4,080,305 issued to Holdt, et al.; 4,395,344 to Maddox; 4,587,032 to Rogers; 4,540,506 issued to Jacobson, et al;. 4,610,800 to Durham, et al.; and European Patent Applications 0,178,931 and 0,185,528, both to Swann, et al. Generally, workers in this field have directed their efforts toward actives, or combinations of actives, which would have improved efficacy or speed when used on typically-encountered clog materials; or are safer to use. A problem with this approach, however, is that regardless of the effectiveness of the active, if the composition is not fully delivered to the clog, the effectiveness of the active will be diminished or destroyed. This is particularly apparent where the clogged drain results in a pool of standing water, and a drain opener composition added to such standing water will be substantially diluted thereby. The above European Patent Applications of Swann, et al. disclose an attempt to overcome the delivery problem by encapsulating actives in polymeric beads. The Rogers and Durham, et al. patents refer to the delivery problem and mention that a thickener is employed to increase the solution viscosity and mitigate dilution. Similarly, a thickener is optionally included in the formulation of Jacobson, et al.

The parent application disclosed such cleaning compositions with quaternary ammonium surfactants, preferably CETAC as discussed below, and either a single counterion or mixed counterions for providing enhanced rheological properties while maintaining phase stability of the composition.

SUMMARY OF THE PRESENT INVENTION

In view of the prior art, there remains a need for a thickened cleaning composition with a viscoelastic rheology, enabling its use as a drain cleaning composition. There further remains a need for a viscoelastic, thickened cleaning composition which is phase-stable, even at high viscosities and low temperatures, and can be economically formulated.

It is therefore an object of the present invention to provide a viscoelastic, thickened cleaning composition and a method of its use in cleaning applications.

It is another object of the present invention to provide a cleaning composition having utility as a drain cleaner and suitable for use in a method of drain cleaning by virtue of its viscoelastic rheology.

It is yet another object of the present invention to provide a drain cleaning composition which is highly effective for its intended use.

It is yet another object of the present invention to provide a viscoelastic thickened cleaning composition which is phase-stable during normal storage, at elevated or very low temperatures, even in the presence of bleach, and a corresponding method of use.

It is another object of the present invention to provide a stable thickened hypochlorite composition with a viscoelastic rheology.

It is another object of the present invention to provide a viscoelastic thickening system which is effective at both high and low ionic strength.

It is another object of the present invention to provide a cleaning composition having a viscoelastic rheology to simplify filling of containers during manufacturing, and to facilitate dispensing by the consumer.

Briefly, a first embodiment of the present invention comprises a phase stable cleaning composition having a viscoelastic rheology comprising, in aqueous solution:

(a) an active cleaning compound;

(b) an alkyl quaternary ammonium surfactant with the alkyl group at least 14 carbons in length;

(c) an organic counterion; and (d) a free amine limited to about 2.5% based on the surfactant and being a primary, secondary or tertiary amine.

The limited amount or absence of free amine in the composition based upon the quaternary ammonium surfactant and counterions is important or essential for achieving phase stability and also for achieving desirable theological or aesthetic properties in the composition.

The quaternary ammonium compound or surfactant is preferably selected from groups having the following structures:

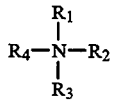

(1)

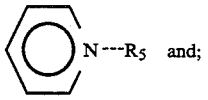

(2)

(3) mixtures thereof;

wherein $R_1$, $R_2$ and $R_3$ are the same or different and are methyl, ethyl, propyl, isopropyl, or benzyl, $R_4$ is $C_{14-18}$ alkyl, and $R_5$ is $C_{12-18}$ alkyl.

The groups or classes of quaternary ammonium surfactants specified above are particularly preferred for achieving desired viscoelastic properties in the composition.

It should be noted that as used herein the term "cleaning" refers generally to a chemical, physical or enzymatic treatment resulting in the reduction or removal of unwanted material, and "cleaning composition" specifically includes drain openers, hard surface cleaners and bleaching compositions. The cleaning composition may consist of a variety of chemically, physically or enzymatically reactive active ingredients, including solvents, acids, bases, oxidants, reducing agents, enzymes, detergents and thioorganic compounds.

Viscoelasticity is imparted to the cleaning composition by a system including a quaternary ammonium compound and an organic counterion selected from the group consisting of alkyl and aryl carboxylates, alkyl and aryl sulfonates, sulfated alkyl and aryl alcohols, and mixtures thereof. The counterion may include substituents which are chemically stable with the active cleaning compound. Preferably, the substituents are alkyl or alkoxy groups of 1–4 carbons, halogens and nitro groups, all of which are stable with most actives, including hypochlorite.

In accordance with the present invention, as also noted above, it has been surprisingly found that free amine can adversely affect phase stability, viscosity and pouring behavior of an aqueous viscoelastic solution containing an alkyl trimethyl ammonium compound. The viscosity of the formulations of the present invention can range from slightly greater than that of water, to several thousand centipoise (cP). Preferred from a consumer standpoint is a viscosity range of about 20 cP to 1000 cP, more preferred is about 50 cP to 500 cP.

In a second embodiment the present invention is formulated as a thickened hypochlorite-containing composition having a viscoelastic theology, and comprises, in aqueous solution:

(a) a hypochlorite bleach;

(b) an alkyl quaternary ammonium compound or surfactant;

(c) a bleach-stable organic counterion; and (d) a free amine with a composition and in amounts as specified above.

Also, the alkyl quaternary ammonium compound or surfactant preferably is selected from a group as defined above.

A third embodiment of the present invention comprises a composition and method for cleaning drains, the composition having a viscoelastic rheology and comprising, in aqueous solution:

(a) a drain opening active;

(b) an alkyl quaternary ammonium compound or surfactant;

(c) a bleach-stable organic counterion; and (d) a free amine of a type and in amounts as specified above.

The composition is utilized by pouring an appropriate amount into a clogged drain. The viscoelastic thickener acts to hold the active components together, allowing the solution to travel through standing water with very little dilution. The viscoelastic thickener also yields increased percolation times through porous or partial clogs, affording longer reaction times to enhance clog removal.

Also, the alkyl quaternary ammonium compound or surfactant preferably is selected from a group as defined above.

It is an advantage of the present invention that the cleaning composition is thickened, with a viscoelastic rheology.

It is another advantage of the present invention that the viscoelastic thickener is chemically and phase-stable in the presence of a variety of cleaning actives, including hypochlorite, and retains such stability at both high and low temperatures.

It is another advantage of the present invention that the viscoelastic thickener yields a stable viscous solution at relatively low cost.

It is another advantage of the present invention that the improved efficacy resulting from the viscoelastic rheology allows for safer drain cleaning formulations with lower levels of, or less toxic, actives.

It is a further advantage of the present invention that the viscoelastic rheology and stability is effective at both high and low ionic strength.

It is yet another advantage of the composition of the present invention that thickening is achieved with relatively low levels of surfactant, improving chemical and physical stability.

These and other objects and advantages of the present invention will no doubt become apparent to those skilled in the art after reading the following Detailed Description of the Preferred Embodiments and with reference to the accompanying drawing.

DETAILED DESCRIPTION OF THE PREFERRED EMBODIMENTS

Figure 1:
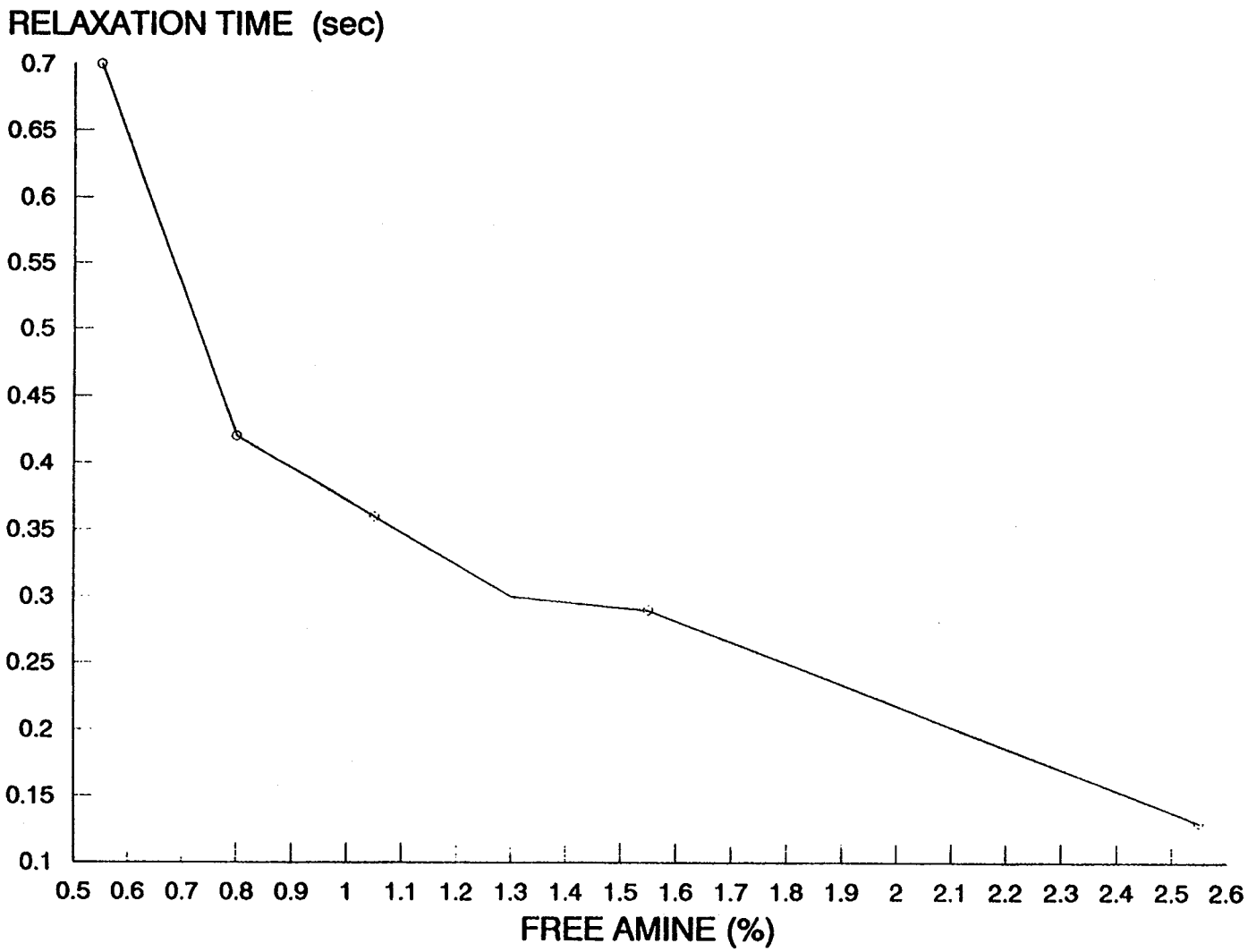
FIG. 1 is a graphical representation of rheological properties (relaxation time) produced by variations in a cleaning composition according to the present invention.
Figure 2:
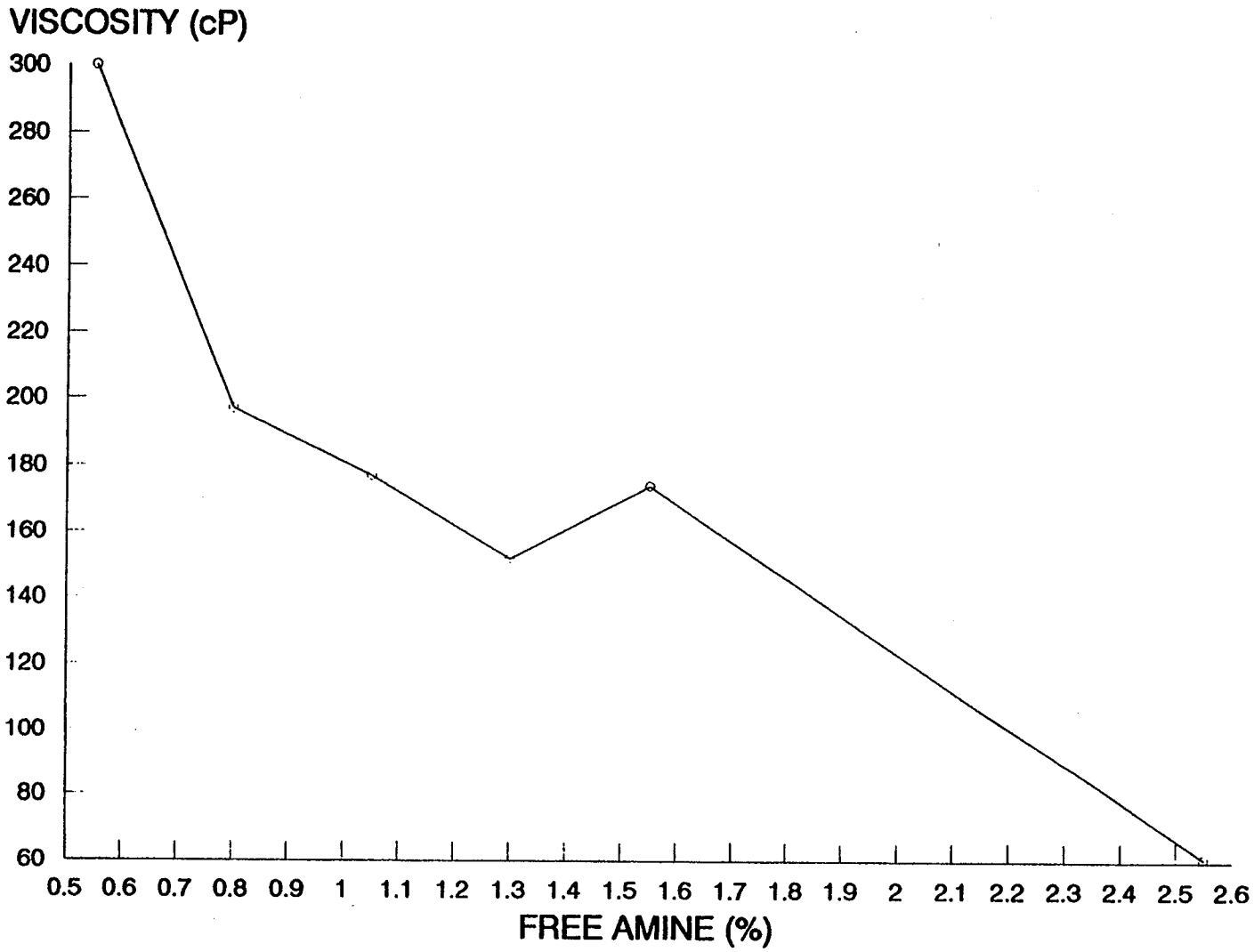
FIG. 2 is a graphical representation of rheological properties (viscosity) produced by variations in a cleaning composition according to the present invention.

In a first embodiment, the present invention is a thickened viscoelastic cleaner comprising, in aqueous solution;

(a) an active cleaning compound;

(b) an alkyl quaternary ammonium surfactant with the alkyl group at least 14 carbons in length;

(c) an organic counterion; and (d) a free amine limited to about 2.5% based on the surfactant and being a primary, secondary or tertiary amine.

Active Cleaning Compounds

A number of cleaning compounds are known and are compatible with the viscoelastic thickener. Such cleaning compounds interact with their intended target materials either by chemical or enzymatic reaction or by physical interactions, which are hereinafter collectively referred to as reactions. Useful reactive compounds thus include acids, bases, oxidants, reductants, solvents, enzymes, thioorganic compounds, surfactants (detergents) and mixtures thereof. Examples of useful acids include: carboxylic acids such as citric or acetic acids, weak inorganic acids such as boric acid or sodium bisulfate, and dilute solutions of strong inorganic acids such as sulfuric acid. Examples of bases include the alkali metal hydroxides, carbonates, and silicates, and specifically, the sodium and potassium salts thereof. Oxidants, e.g., bleaches are a particularly preferred cleaning active, and may be selected from various halogen or peroxygen bleaches. Examples of suitable peroxygen bleaches include hydrogen peroxide and peracetic acids. Examples of enzymes include proteases, amylases, and cellulases. Useful solvents include saturated hydrocarbons, ketones, carboxylic acid esters, terpenes, glycol ethers, and the like. Thioorganic compounds such as sodium thioglycolate can be included to help break down hair and other proteins. Various nonionic, anionic, cationic or amphoteric surfactants can be included, as known in the art, for their detergent properties. Examples include taurates, sarcosinates and phosphate esters. Preferred cleaning actives are oxidants, especially hypochlorite, and bases such as alkali metal hydroxides. Most preferred is a mixture of hypochlorite and an alkali metal hydroxide. The cleaning active as added in a cleaning-effective amount, which may range from about 0.05 to 50 percent by weight, depending on the active.

Quaternary Ammonium Compound

The viscoelastic thickener is formed by combining a compound having a quaternary nitrogen, e.g. quaternary ammonium compounds (quats) with an organic counterion. The quaternary ammonium compound is selected from the group consisting of those having the following structures:

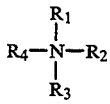

(i)

wherein R, $R_1$, $R_2$ and $R_3$ are the same or different, and are methyl, ethyl, propyl, isopropyl or benzyl, and $R_4$ is $C_{12-18}$;

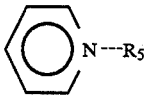

(ii)

wherein $R_5$ is $C_{12-18}$ alkyl, and;

(iii) mixtures thereof.

Most preferred, especially if ionic strength is present, is a $C_{14-18}$ alkyl trimethyl ammonium chloride and especially cetyltrimethyl ammonium chloride (CETAC). It is noted that when referring to carbon chain lengths of the quaternary ammonium compound or any other compound herein, the commercial, polydisperse forms are contemplated. Thus, a given chain length within the preferred $C_{14-18}$ range will be predominately, but not exclusively, the specified length. The pyridinium and benzyldimethyl ammonium headgroups are not preferred if ionic strength is high. Also, it is preferred that if $R_1$ is benzyl, $R_2$ and $R_3$ are not benzyl. Commercially available quats are usually associated with an anion. Such anions are fully compatible with the counterions of the present invention, and generally do not detract from the practice of the invention. Most typically, the anion is chloride and bromide, or methylsulfate. Where the cleaning active includes hypochlorite, however, the bromide anion is not preferred.

The quaternary ammonium compound is added at levels, which, when combined with the organic counterion are thickening effective. Generally about 0.1 to 10.0 weight percent of the quaternary ammonium compound is utilized, and preferred is to use about 0.3 to 3.0% quaternary ammonium compound.

Organic Counterion

The organic counterion is selected from the group consisting of $C_{2-10}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, and preferred are those having two to eight carbon atoms. The counterions may be added in acid form and converted to the anionic form in situ, or may be added in anionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. The counterion is added in an mount sufficient to thicken and result in a viscoelastic theology, and preferably between about 0.01 to 10 weight percent. A preferred mole ratio of quaternary ammonium compound to counterion is between about 12:1 and 1:6, and a more preferred ratio is about 6:1 to 1:3. Without limiting to a particular theory, it is thought that the counterion promotes the formation of elongated micelles of the quaternary ammonium compound. These micelles can form a network which results in efficient thickening. It has been surprisingly found that the viscoelastic thickening as defined herein occurs only when the counterion is minimally or non surface-active. Experimental data shows that, generally, the counterions of the present invention should be soluble in water. Surface-active counterions normally don't work, unless they have a have a critical micelle concentration (CMC) greater than about 0.1 molar as measured in water at room temperature (about 70° F.). Counterions having a CMC less than this are generally too insoluble to be operable. For example, sodium and potassium salts of straight chain fatty acids (soaps), having a chain length of less than ten carbons, are suitable, however, longer chain length soaps generally don't work because their CMC's are less than about 0.1 molar. See Milton J. Rosen, *Surfactants and Interfacial Phenomena*, John Wiley and Sons.

TABLE I

| | | | | Effect of Counterions | | | | | | |
|---|---|---|---|---|---|---|---|---|---|---|
| | CETAC | Counterion | | Viscosity (cP) | | No. of Phases at Indicated Temp. (°F.) | | | | |
| No. | Wt. % | Wt. % | Name | 3 rpm | 30 rpm | 12 | 30 | 71 | 107 | 127 |
| 1 | 0.50 | None | None | — | 14 | 2 | 2 | 1 | | |
| 2 | 0.50 | 0.010 | AA | 90 | 74 | 2 | 2 | 1 | 1 | 1 |
| 3 | 0.50 | 0.200 | AA | 100 | 81 | 2 | 2 | 1 | 1 | 1 |
| 4 | 0.50 | 0.050 | BA | 100 | 76 | | | | | |
| 5 | 0.50 | 0.450 | BA | 40 | 38 | 2 | 2 | 1 | 1 | 1 |
| 6 | 0.50 | 0.050 | OA | 50 | 40 | | | 1 | | |
| 7 | 0.50 | 0.200 | OA | 80 | 74 | | | 1 | | |
| 8 | 0.50 | 0.050 | SOS | 220 | 165 | 2 | 2 | 1 | 1 | 1 |
| 9 | 0.50 | 0.100 | SOS | 280 | 229 | 2 | 2 | 1 | 1 | 1 |
| 10 | 0.75 | 0.150 | SOS | 400 | 353 | 2 | 2 | 1 | 1 | 1 |
| 11 | 0.48 | 0.180 | BZA | — | 2 | | 2 | 1 | 1 | 1 |
| 12 | 0.48 | 0.170 | 4-TA | 10 | 14 | | 1C | 1 | 1 | 1 |
| 13 | 0.22 | 0.200 | 4-CBA | 400 | 135 | 2 | 2 | 1 | 1 | 1 |
| 14 | 0.30 | 0.300 | 4-CBA | 960 | 202 | 2 | 2 | 1 | 1 | 1 |
| 15 | 0.50 | 0.050 | 4-CBA | 380 | 213 | 2 | 2 | 1 | 1 | 1 |
| 16 | 0.50 | 0.125 | 4-CBA | 2010 | 507 | | | 1 | | |
| 18 | 0.50 | 0.250 | 4-CBA | 4180 | 820 | | | 1 | | |
| 19 | 0.50 | 0.375 | 4-CBA | 5530 | 1000 | | | 1 | | |
| 20 | 0.50 | 0.500 | 4-CBA | 4660 | 770 | | | 1 | | |
| 22 | 0.50 | 0.625 | 4-CBA | 3180 | 606 | | | 1 | | |
| 23 | 0.50 | 0.750 | 4-CBA | 1110 | 341 | | | 1 | | |
| 24 | 0.50 | 0.875 | 4-CBA | 170 | 125 | | | 1 | | |
| 25 | 0.50 | 1.000 | 4-CBA | 30 | 20 | | | 1 | | |
| 26 | 0.70 | 0.100 | 4-CBA | 250 | 167 | 2 | 2 | 1 | 1 | 1 |
| 27 | 0.70 | 0.300 | 4-CBA | 4640 | 791 | 2 | 2 | 1 | 1 | 1 |
| 28 | 0.78 | 0.200 | 4-CBA | 3110 | 622 | 2 | 2 | 1 | 1 | |
| 29 | 1.20 | 0.300 | 4-CBA | 940 | 685 | | 2 | 1 | 1 | 1 |
| 30 | 0.50 | 0.200 | 2-CBA | 10 | 7 | | 2 | 1 | 1 | 1 |
| 31 | 0.50 | 0.200 | 2,4-DBA | 1920 | 658 | | 2 | 1 | 1 | 1 |
| 32 | 0.50 | 0.200 | 4-NBA | 10 | 19 | | 2 | 1 | 1 | 1 |
| 33 | 0.48 | 0.210 | SA | 1040 | 359 | 1C | 1C | 1 | | |
| 34 | 0.50 | 0.150 | NA | 750 | 306 | 2 | 1C | 1 | 1 | 1 |
| 35 | 0.50 | 0.030 | PA | 70 | 73 | 2 | 2 | 1 | 1 | 1 |
| 36 | 0.50 | 0.400 | PA | 80 | 64 | 2 | 2 | 1 | 1 | 1 |
| 37 | 0.50 | 0.100 | BSA | 40 | 46 | 2 | 2 | 1 | | |
| 38 | 0.50 | 0.200 | BSA | 150 | 175 | 2 | 2 | 1 | | |
| 39 | 0.50 | 0.400 | BSA | 220 | 175 | 2 | 1C | 1 | | |
| 40 | 0.50 | 0.100 | TSA | 360 | 223 | 2 | 2 | 1 | 1 | 1 |
| 41 | 0.50 | 0.200 | TSA | 370 | 260 | 2 | 2 | 1 | 1 | 1 |
| 42 | 0.50 | 0.300 | TSA | 290 | 238 | | 2 | 1 | 1 | 1 |
| 43 | 0.50 | 0.150 | SCS | thick | thick | | | 2 | | |
| 44 | 0.50 | 0.030 | SXS | 150 | 119 | 2 | 2 | 2 | 1 | 1 |
| 45 | 0.50 | 0.100 | SXS | 610 | 279 | | 2 | 1 | 1 | 1 |
| 46 | 0.50 | 0.150 | SXS | 260 | 224 | | 2 | 1 | 1 | 1 |
| 47 | 0.50 | 0.200 | SXS | 130 | 123 | 2 | 2 | 1 | 1 | 1 |
| 48 | 0.97 | 0.630 | SXS | 100 | 120 | 1C | 1 | 1 | 2 | 2 |
| 49 | 0.50 | 0.050 | 4-CBS | 150 | 118 | 2 | 2 | 1 | | |
| 50 | 0.50 | 0.100 | 4-CBS | 420 | 248 | 2 | 1C | 1 | | |
| 51 | 0.50 | 0.200 | 4-CBS | 140 | 149 | 2 | 2 | 1 | | |
| 52 | 0.50 | 0.050 | MNS | 290 | 202 | 2 | 2 | 1 | 1 | 1 |
| 53 | 0.50 | 0.100 | MNS | 220 | 208 | 2 | 2 | 1 | 1 | 1 |

TABLE I-continued

| | CETAC | Counterion | | Effect of Counterions Viscosity (cP) | | No. of Phases at Indicated Temp. (°F.) | | | | |
|---|---|---|---|---|---|---|---|---|---|---|
| No. | Wt. % | Wt. % | Name | 3 rpm | 30 rpm | 12 | 30 | 71 | 107 | 127 |
| 54 | 0.70 | 0.150 | MNS | 480 | 390 | 2 | 2 | 1 | 1 | 1 |

CETAC = Cetyltrimethylammonium Chloride
AA = Acetic Acid
BA = Butyric Acid
OA = Octanoic Acid
SOS = Soium Octylsulfonate
BZA = Benzoic Acid
4-TA = 4-Toluic Acid
4-CBA = 4-Chlorobenzoic Acid
2-CBA = 2-Chlorobenzoic Acid
2,4-DBA = 2,4-Dichlorobenzoic Acid
4-NBA = 4-Nitrobenzoic Acid
SA = Salicylic Acid
NA = Naphthoic Acid
PA = Phthalic Acid
BSA = Benzenesulfonic Acid
TSA - Toluenesulfonic Acid
SCS = Sodium Cumenesulfonate
SXS = Sodium Xylenesulfonate
4-CBS = 4-Chlorobenzenesulfonate
MNS = Methylnaphthalenesulfonate
C = Cloudy
All formulas contain 0.113 wt. % of sodium silicate ($SiO_2Na_2O$ = 3.22; 5.5–5.8% sodium hypochlorite, 4.3–4.7 wt. % sodium chloride and 1.4–1.9 wt. % sodium hydroxide.
Viscosities were measured at 72–81° F. with a Brookfield rotoviscometer model LVTD using spindle #2.

Table 1 shows the effect on viscosity and phase stability of a number of different counterions. The quaternary ammonium compound in each example is CETAC, and about 5.5–5.8 weight percent sodium hypochlorite, 4–5 weight percent sodium chloride, and about 1.4–1.9 weight percent sodium hydroxide are also present.

Examples 15–25 and 44–47 of Table I show that viscosity depends on the ratio of counterion to quaternary ammonium compound. When the quaternary ammonium compound is CETAC and the counterion is 4-chlorobenzoic acid, maximum viscosity is obtained at a quaternary ammonium compound to counterion weight ratio of about 4:3. With CETAC and sodium xylene sulfonate, the ratio is about 5:1 by weight.

The formulations of the present invention may utilize a mixture of two or more counterions, preferably a mixture of a carboxylate and a sulfonate. As used herein sulfonate-containing counterions include the sulfated alcohol counterions. Examples of such mixtures are shown in Table II. Examples of preferred carboxylates are benzoate, 4-chlorobenzoate, napthoate, 4-toluate and octanoate. Preferred sulfonates include xylenesulfonate, 4-chlorobenzenesulfonate and toluene sulfonate. Most preferred is a mixture of at least one of the group consisting of 4-toluate, 4-chlorobenzoic acid and octanoate with sodium xylenesulfonate. A preferred ratio of carboxylate to sulfonate is between about 6:1 to 1:6, more preferred is between about 3:1 to 1:3. Mixtures of counterions may also act to synergistically increase viscosity, especially at low ratios of counterion to quaternary ammonium compound. Such synergism appears in some cases even if one of the counterions results in poor phase stability or low viscosity when used alone. For example, samples 11 and 46 of Table 1 (benzoic acid and sodium xylenesulfonate, respectively) yield low viscosities (2 cP and 224 cP respectively) and are phase instable at 30° F. When combined, however, as shown by samples 3–5 of Table II. The formulations are all phase-stable even at 0° F., and sample 5 shows a much higher viscosity than that of the same components individually.

TABLE II

| | CETAC | Counterion | | Counterion | | Effect of Mixed Counterions Viscosity cP | | Number of Phases at Indicated Temperature (°F.) | | | | | |
|---|---|---|---|---|---|---|---|---|---|---|---|---|---|
| No. | Wt. % | Wt. % | Name | Wt. % | Name | 3 rpm | 30 rpm | 0 | 12 | 30 | 71 | 107 | 127 |
| 1 | 0.50 | 0.20 | BA | 0.20 | BSA | 170 | 136 | 2 | 2 | 1C | 1 | 1 | 1 |
| 2 | 0.50 | 0.30 | BA | 0.10 | 4-CBSA | 1070 | 408 | 1F | 1C | 1C | 1 | 1 | 1 |
| 3 | 0.60 | 0.24 | BA | 0.24 | SXS | 180 | 173 | 1F | 1C | 1 | 1 | 1 | 1 |
| 4 | 0.62 | 0.10 | BA | 0.32 | SXS | 100 | 74 | 1C | 1C | 1 | 1 | 1 | 1 |
| 5 | 0.62 | 0.45 | BA | 0.15 | SXS | 690 | 424 | 1C | 1C | 1 | 1 | 1 | 1 |
| 6 | 0.62 | 0.09 | 4-CBA | 0.20 | BA | 1340 | 429 | 1F | 1C | 1C | 1 | 1 | 1 |
| 7 | 0.62 | 0.09 | 4-CBA | 0.30 | p-TA | 7680 | 2440 | 2 | 2 | 2 | 1 | 1 | 1 |
| 8 | 0.62 | 0.09 | 4-CBA | 0.20 | 2-CBA | 1160 | 414 | 1C | 2 | 1C | 1 | 1 | 1 |
| 9 | 0.62 | 0.09 | 4-CBA | 0.20 | 4-NBA | 840 | 387 | 1C | 1C | 1 | 1 | 1 | 1 |
| 10 | 0.31 | 0.05 | 4-CBA | 0.10 | NA | 790 | 290 | 1F | 1C | 1 | 1 | 1 | 1 |
| 11 | 0.62 | 0.09 | 4-CBA | 0.10 | NA | 3400 | 1025 | 1F | 1C | 1C | 1 | 1 | 1 |
| 12 | 0.62 | 0.09 | 4-CBA | 0.30 | NA | 5560 | 2360 | 2 | 2 | 1 | 1 | 1 | 1 |
| 13 | 0.50 | 0.10 | 4-CBA | 0.15 | OA | 60 | 54 | | | | 1 | 1 | 1 |
| 14 | 0.62 | 0.09 | 4-CBA | 0.20 | BSA | 2410 | 695 | 1F | 1C | 1C | 1 | 1 | 1 |
| 15 | 0.15 | 0.05 | 4-CBA | 0.05 | TSA | 140 | 56 | 2 | 2 | 2 | 1 | 1 | 1 |
| 16 | 0.30 | 0.10 | 4-CBA | 0.10 | TSA | 1140 | 270 | 2 | 2 | 1 | 1 | 1 | |
| 17 | 0.50 | 0.20 | 4-CBA | 0.10 | TSA | 2520 | 625 | 2 | 2 | 2 | 1 | 1 | 1 |
| 18 | 0.30 | 0.08 | 4-CBA | 0.08 | SXS | 400 | 142 | 2 | 2 | 1 | 1 | 1 | 1 |
| 19 | 0.30 | 0.10 | 4-CBA | 0.10 | SXS | 635 | 142 | 2 | 2 | 2 | 1 | 1 | 1 |
| 20 | 0.30 | 0.12 | 4-CBA | 0.30 | SXS | 200 | 140 | 1F | 1 | 1 | 1 | 1 | 1 |
| 21 | 0.37 | 0.11 | 4-CBA | 0.22 | SXS | 470 | 270 | 2 | 1 | 1 | 1 | 1 | 1 |
| 22 | 0.48 | 0.06 | 4-CBA | 0.32 | SXS | 80 | 91 | 1F | 1C | 1 | 1 | 1 | 1 |
| 23 | 0.50 | 0.10 | 4-CBA | 0.18 | SXS | 440 | 344 | 1F | 1C | 1 | 1 | 1 | 1 |

TABLE II-continued

| | CETAC | Counterion | | Counterion | | Viscosity cP | | Number of Phases at Indicated Temperature (°F.) | | | | | |
|---|---|---|---|---|---|---|---|---|---|---|---|---|---|
| | | Effect of Mixed Counterions | | | | | | | | | | | |
| No. | Wt. % | Wt. % | Name | Wt. % | Name | 3 rpm | 30 rpm | 0 | 12 | 30 | 71 | 107 | 127 |
| 24 | 0.50 | 0.10 | 4-CBA | 0.10 | SXS | 1100 | 313 | 2 | 2 | 2 | 1 | 1 | 1 |
| 25 | 0.50 | 0.12 | 4-CBA | 0.35 | SXS | 402 | 320 | 1F | 1 | 1 | 1 | 1 | 1 |
| 26 | 0.50 | 0.13 | 4-CBA | 0.50 | SXS | 250 | 221 | 1F | 1 | 1 | 1 | 1 | 1 |
| 27 | 0.50 | 0.15 | 4-CBA | 0.15 | SXS | 4760 | 1620 | 2 | 2 | 1 | 1 | 1 | 1 |
| 28 | 0.50 | 0.15 | 4-CBA | 0.25 | SXS | 970 | 382 | 2 | 2 | 1 | 1 | 1 | 1 |
| 29 | 0.50 | 0.15 | 4-CBA | 0.50 | SXS | 470 | 350 | 1F | 1 | 1 | 1 | 1 | 1 |
| 30 | 0.50 | 0.38 | 4-CBA | 1.13 | SXS | 60 | 45 | | 1 | 1 | 1 | 1 | 1 |
| 31 | 0.69 | 0.17 | 4-CBA | 0.45 | SXS | 720 | 576 | 1C | 1 | 1 | 1 | 1 | 1 |
| 32 | 0.69 | 0.20 | 4-CBA | 0.40 | SXS | 3140 | 894 | 1F | 1 | 1 | 1 | 1 | 1 |
| 33 | 0.82 | 0.13 | 4-CBA | 0.35 | SXS | 440 | 450 | 1F | 1C | 1 | 1 | 1 | 1 |
| 34 | 0.89 | 0.09 | 4-CBA | 0.31 | SXS | 520 | 531 | 1C | 2 | 1 | 1 | 1 | 1 |
| 35 | 0.90 | 0.13 | 4-CBA | 0.26 | SXS | 1950 | 1630 | 2 | 2 | 1 | 1 | 1 | 1 |
| 36 | 0.50 | 0.10 | 2-CBA | 0.15 | SXS | 140 | 128 | 1F | 2 | 1C | 1 | 1 | 1 |
| 37 | 0.62 | 0.10 | 2,4-D | 0.32 | SXS | 100 | 86 | 1F | 1C | 1 | 1 | 1 | 1 |
| 38 | 0.50 | 0.10 | 4-NBA | 0.20 | BSA | 310 | 206 | 1F | 2 | 1C | 1 | 1 | 1 |
| 39 | 0.50 | 0.10 | 4-NBA | 0.05 | 4-CBSA | 360 | 200 | 1F | 2 | 1C | 1 | 1 | 1 |
| 40 | 0.62 | 0.12 | 4-NBA | 0.32 | SXS | 100 | 95 | 1F | 1C | 1 | 1 | 1 | 1 |
| 41 | 0.50 | 0.20 | PA | 0.10 | SXS | 180 | 165 | | 2 | 2 | 1 | 1 | 1 |
| 42 | 0.15 | 0.05 | NA | 0.05 | SXS | 40 | 27 | 1F | 1C | 1 | 1 | 1 | 1 |
| 43 | 0.20 | 0.10 | NA | 0.10 | SXS | 90 | 54 | 2 | 1C | 1 | 1 | 1 | 1 |
| 44 | 0.40 | 0.10 | NA | 0.20 | SXS | 110 | 100 | 1C | 1C | 1 | 1 | 1 | 1 |
| 45 | 0.60 | 0.10 | NA | 0.20 | SXS | 340 | 294 | 2 | 2 | 1 | 1 | 1 | 1 |
| 46 | 0.62 | 0.15 | NA | 0.32 | SXS | 160 | 141 | 1C | 1C | 1 | 1 | 1 | 1 |
| 47 | 0.50 | 0.10 | NA | 0.10 | 4-CBSA | 1210 | 356 | 1F | 1C | 1 | 1 | 1 | 1 |
| 48 | 0.50 | 0.15 | SXS | 0.20 | BSA | 190 | 135 | 2 | 2 | 1C | 1 | 1 | 1 |
| 49 | 0.50 | 0.04 | SXS | 0.06 | TSA | 400 | 212 | 2 | 2 | 2 | 1 | 1 | 1 |
| 50 | 0.50 | 0.12 | SXS | 0.08 | TSA | 250 | 224 | 2 | | 1 | 1 | 1 | 1 |
| 51 | 0.50 | 0.12 | SXS | 0.18 | TSA | 170 | 150 | 2 | 2 | 2 | 1 | 1 | 1 |
| 52 | 0.50 | 0.15 | SXS | 0.05 | 4-CBSA | 90 | 82 | 2 | 1C | 1 | 1 | 1 | 1 |
| 53 | 0.50 | 0.05 | OA | 0.20 | SXS | 180 | 166 | 1F | 1C | 1 | 1 | 1 | 1 |
| 54 | 0.50 | 0.10 | OA | 0.15 | SXS | 310 | 248 | 2 | 1C | 1 | 1 | 1 | 1 |
| 55 | 0.60 | 0.15 | OA | 0.10 | SXS | 340 | 283 | 2 | 1C | 1C | 1 | 1 | 1 |
| 56 | 0.50 | 0.15 | OA | 0.20 | SXS | 210 | 175 | 1F | 1C | 1 | 1 | 1 | 1 |
| 57 | 0.50 | 0.20 | OA | 0.10 | SXS | 160 | 135 | 1F | 1C | 1 | 1 | 1 | 1 |
| 58 | 0.50 | 0.06 | Na OS | 0.06 | MNS | 200 | 182 | 2 | 2 | 2 | 1 | 1 | 1 |

CETAC = Cetyltrimethylammonium Chloride
BA = Benzoic Acid
p-TA = p-Toluic Acid
NA = Naphthoic Acid
OA = Otanoic Acid
PA = Phthalic Acid
Na OS = Na Octylsulfonate
4-CBA = 4-Chlorobenzoic Acid
SXS = Soidum Xylenesulfonate
BSA = Benzenesulfonic Acid
TSA = Toluenesulfonic Acid
4-CBSA = 4-Chlorobenzenesulfonic Acid
2-CBA = 2-Chlrorbenzoic Acid
2,4-D = 2,4-Dichlorobenzoic Acid
4-NBA = 4-Nitrobenzoic Acid
MNS = Methylnaphthalenesulfonate
C = Cloudy
F = Frozen
All formulas contain 0.113 wt. % of sodium silicate ($SiO_2/Na_2O$ = 3.22); 5.6–5.8 wt. % sodium hypochlorite; 4–5 wt. % sodium chloride and 1.7–1.8 wt. % sodium hydroxide.
Viscosities were measured at 72–81° F. with a Brookfield rotoviscometer model LVTD using spindle #2.

Free Amine

It has been surprisingly discovered that the free amine levels in the viscoelastic-thickener consisting of an alkyl quaternary ammonium compound, alkyl or aryl carboxylate and/or sulfonate, can impact phase and rheology stability.

The free amine in the cleaning compositions of the present invention may be introduced as an adjunct or impurity with the quaternary ammonium surfactant or may be introduced into the compositions of the present invention as a separate component if desired. the free amine is a primary, secondary or tertiary amine as noted above and may preferably have the following structure:

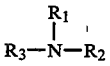

wherein $R_1$ and $R_2$ are the same or different and are hydrogen, methyl, ethyl, propyl, isopropyl or benzyl and $R_3$ is $C_{12-18}$ alkyl.

The limited amount or absence of the amine is critical in determining phase stability and theological properties. The optimum amount depends to some degree on the nature and amount of the alkyl quaternary and the counterion(s). In general, decreasing the amount of free amine improves phase stability and increases viscosity and elasticity. However, as discussed below, elasticity needs to be minimized for certain consumer products. This can be accomplished in part by increasing the amount of free amine.

The above considerations result in an optimum free amine range of about 0.1 to 2.5% by wt. of the quaternary ammonium surfactant, preferably about 0.2 to 2.0% by wt. of the quaternary ammonium surfactant. More preferably, with a mixture of carboxylate and sulfonate counterions, the free amine range is about 0.8 to 1.8% by wt. of the quaternary ammonium surfactant and, with only a sulfonate counterion, the free amine range is about 0.2 to 1.0% by wt. of the quaternary ammonium surfactant.

As noted above, some of the same effects of controlling the amount of free amine can be achieved by using a mixture of sulfonate and carboxylate counterions. A particular advantage of controlling the free amine in the range of about 0.2 to 1.0% by wt. of the quaternary ammonium surfactant is that equally effective compositions can be made using only sulfonate counterion, thus improving storage stability of hypochlorite products since the total amount of potential substrate is reduced. The use of a single counterion also simplifies the manufacturing process and reduces cost thereof.

It should also be noted that typical commercial quaternary ammonium compounds have more than one percent free amine. As stated above, the present invention preferably contemplates reduction of the amount of free amine below that level.

The preferred ranges for free amine according to the present invention are further illustrated in Table III below.

TABLE III

Amount of Free Amine in Compositions of Invention

| | Free Amine as a % of Quaternary ammonium surfactant % | |
|---|---|---|
| | Minimum | Mamximum |
| A. Broad limits of invention for achieving phase stability | 0.1 | 2.5 |
| B. Preferred range for achieving good rheological and aesthetic characteristics in the composition | 0.2 | 2.0 |
| C. More preferred range for maintaining phase stability and for achieving optimum rheological and aesthetic properties with a mixture of sulfonate and carboxylate counterions | 0.8 | 1.8 |
| D. More preferred range for maintaining phase stability and for achieving optimum rheological and aesthetic properties with only sulfonate counterion | 0.2 | 1.0 |

As noted above, the maximum limits for free amine in the compositions of the present invention are essential for maintaining phase stability and rheological and aesthetic properties as noted. The minimum amounts of the free amine are of secondary importance.

Additional advantages for the present invention are demonstrated in the following tables.

The viscoelasticity of the thickener advantageously imparts unusual flow properties to the cleaning composition. Elasticity causes the stream to break apart and snap back into the bottle at the end of pouring instead of forming syrupy streamers. Further, elastic fluids appear more viscous than their viscosity indicates. Instruments capable of performing oscillatory or controlled stress creep measurements can be used to quantify elasticity. Some parameters can be measured directly (see Hoffmann and Rehage, *Surfactant Science Series*, 1987, Vol. 22, 299–239 and EP 204,472), or they can be calculated using models. Increasing relaxation times indicate increasing elasticity, but elasticity can be moderated by increasing the resistance to flow. Since the static shear modulus is a measure of the resistance to flow, the ratio of the relaxation time (Tau) to the static shear modulus (GO) is used to measure relative elasticity. Tau and GO can be calculated from oscillation data using the Maxwell model. Tau can also be calculated by taking the inverse of the frequency with the maximum loss modulus. GO is then obtained by dividing the complex viscosity by Tau. To obtain the full benefits of the viscoelastic thickener, the Tau/G0 (relative elasticity) should be greater than about 0.03 sec./Pa.

Some consumers do not like the appearance of elastic flow properties. Thus, for certain products the elasticity should be minimized. It has been empirically determined that good consumer acceptance is usually obtained for solutions with Tau/G0 less than about 0.5 sec/Pa, although much higher relative elasticities can be formulated. The relative elasticity can be varied by varying the types and concentrations of quaternary ammonium compound and counterions, and by adjusting the relative concentrations of counterions and quaternary ammonium compound.

Table IV set forth below presents stability data for compositions similar to those in Tables I and II while further demonstrating phase stability for free amine limitations as summarized above in Table III.

TABLE IV

Stability Data

| No. | CETAC wt. %[a] | Free Amine wt. %[b] | SXS wt. %[c] | 4-CBA wt. %[d] | Number of Phases at indicated temperature (°F.) 0 | 20 | 40 | 70 | 90 | 120 |
|---|---|---|---|---|---|---|---|---|---|---|
| 1 | 0.62 | 0.55 | .29 | .087 | 1 | 1 | 1C | 1 | 1 | 1 |
| 2 | 0.62 | 0.55 | 0 | .087 | 1 | 1 | 2 | 1 | 1 | 1 |
| 3 | 0.62 | 1.15 | .29 | 0.087 | 1 | 1 | 1C | 1 | 1 | 1 |
| 4 | 0.62 | 1.45 | .29 | 0.087 | 1 | 1 | 1C | 1 | 1 | 1 |
| 5 | 0.62 | 0.55 | .29 | 0 | 1 | 1 | 1C | 1 | 1 | 1 |
| 6 | 0.62 | 0.85 | .29 | 0 | 1 | 1 | 1C | 1 | 1 | 2 |
| 7 | 0.62 | 1.15 | .29 | 0 | 1 | 1 | 1C | 1 | 2 | 2 |
| 8 | 0.62 | 1.30 | .29 | 0 | 1 | 1 | 1C | 2 | 2 | 2 |
| 9 | 0.62 | 1.45 | .29 | 0 | 1 | 1 | 1C | 2 | 2 | 2 |

[a]CETAC = Cetyl trimethylammonium chloride
[b]Free Amine = Primary, secondary and/or tertiary amine as a weight % of the CETAC
[c]SXS = Sodium xylene sulfonate
[d]4-CBA = Sodium salt of para-chlorobenzoic acid As noted above, the material presented in Table IV is supplemental to the information in Tables I and II since it relates to the same types of compositions. Table IV provides phase stability information at various temperatures for different compositions according to the present invention. In Table IV, phase stability is of course the prime indication of satisfactory results for the present invention.

It is also to be observed from Table IV that similar results in terms of phase stability and desirable rheological characteristics as discussed below may also be achieved with the formulations in Tables I and II. Although those formulations do not include free amine data, the data from Table IV is believed capable of extrapolation to support similar results with corresponding free amine limits for the compositions in Tables I and II and also in the other following tables which do not specifically include free amine data.

Table V provides rheology data according to the present invention for similar compositions as set forth in Table IV.

TABLE V

Rheology Data

| No. | CETAC wt. %[a] | Free Amine wt. %[b] | SXS wt. %[c] | 4-CBA wt. %[d] | Viscosity.[e] cP | Tau[f] sec. | G0[g] Pa[j] | Tau/G0[h] sec./Pa | Delivery %[i] |
|---|---|---|---|---|---|---|---|---|---|
| 1 | 0.62 | 0.55 | 0.29 | 0.087 | 300 | 0.70 | 2.7 | 0.26 | >90 |
| 2 | 0.62 | 0.80 | 0.29 | 0.087 | 197 | 0.42 | 2.9 | 0.14 | >90 |
| 3 | 0.62 | 1.05 | 0.29 | 0.087 | 177 | 0.36 | 3.0 | 0.12 | >90 |
| 4 | 0.62 | 1.30 | 0.29 | 0.087 | 152 | 0.30 | 3.2 | 0.09 | >90 |
| 5 | 0.62 | 1.55 | 0.29 | 0.087 | 174 | 0.29 | 3.7 | 0.08 | >90 |
| 6 | 0.62 | 2.55 | 0.29 | 0.087 | 61 | 0.13 | 2.8 | 0.05 | <90 |
| 7 | 0.62 | 0.20 | 0.29 | 0 | 137 | 0.34 | 2.5 | 0.14 | >90 |
| 8 | 0.62 | 0.55 | 0.29 | 0 | 156 | 0.33 | 2.8 | 0.12 | >90 |
| 9 | 0.62 | 0.90 | 0.29 | 0 | 95 | 0.21 | 2.9 | 0.07 | >90 |
| 10 | 0.62 | 1.5 | 0.29 | 0 | 72 | 0.16 | 3.0 | 0.05 | <90 |

[a]CETAC = Cetyl trimethylammonium chloride
[b]Free Amine = Primary, secondary and/or tertiary amine as a weight % of the CETAC
[c]SXS = Sodium xylene sulfonate
[d]4-CBA = Sodium salt of para-chlorobenzoic acid
[e]Viscosity in centipoise
[f]Tau = Relaxation time in seconds
[g]G0 = Shear modulus (in Pascals)
[h]Tau/G0 = Relaxation time over shear modulus = Elasticity factor
[i]Delivery = Percentage of product passing through standing water
[j]Pa = Pascals As noted above, the data set forth in Tables IV and V may be extrapolated to also apply to the exemplary compositions set forth in the other tables herein. Furthermore, the desirable phase stability and theology characteristics of the compositions of the present invention, with respect to limitation of the free amine level, is further illustrated in FIGS. I and II.

Table VI shows the effect of composition on theology and corresponding drain cleaning performance. The latter is measured by two parameters: (1) percentage delivery; and (2) flow rate. Percentage delivery was measured by pouring 20 mL of the composition, at 73 oF, into 80 mL of standing water, and measuring the amount of undiluted product delivered. Flow rate was measured by pouring 100 mL of the composition through a 3.2 cm. diameter No. 230 US mesh screen and recording the time to pass through the screen. A delivery of 0% indicates that only diluted product, if any, has reached the clog; a 100% delivery indicates that all of the product, substantially undiluted, has reached the clog. Rheology was measured with a Bolin VOR rheometer at 77° F. in the oscillatory mode. The viscosity is the in-phase component extrapolated to 0 Hertz. The relaxation time, Tau, and the static shear modulus, G0, were calculated using the Maxwell model. The ratio Tau/G0 is, as previously described, postulated to be a measure of relative elasticity.

TABLE VI

Effect of Composition on Rheology and Drain Opener Performance

| No. | CETAC wt. % | SXS wt. % | Counterion wt. % | Counterion type | Viscosity cP | Tau sec. | G0 Pa | Tau/G0 sec./Pa | Delivery % | Flow Rate mL/min |
|---|---|---|---|---|---|---|---|---|---|---|
| 1 | 0.370 | 0.260 | 0.080 | CBA | 47 | 0.33 | 0.93 | 0.35 | — | — |
| 2 | 0.500 | 0.143 | 0.071 | CBA | 247 | 0.84 | 1.86 | 0.45 | 96 | 46 |
| 3 | 0.500 | 0.286 | 0.071 | CBA | 84 | 0.20 | 2.66 | 0.08 | 73 | 150 |
| 4 | 0.500 | 0.350 | 0.120 | CBA | 153 | 0.47 | 2.11 | 0.22 | 96 | 33 |
| 5 | 0.500 | 0.315 | 0.132 | CBA | 560 | 1.29 | 1.83 | 0.71 | — | — |
| 6 | 0.625 | 0.125 | 0.063 | CBA | 716 | 2.00 | 2.25 | 0.89 | 96 | 27 |
| 7 | 0.625 | 0.250 | 0.063 | CBA | 140 | 0.23 | 3.94 | 0.06 | 74 | 109 |
| 8 | 0.625 | 0.313 | 0.156 | CBA | 390 | 0.67 | 3.65 | 0.18 | 96 | 26 |
| 9 | 0.625 | 0.625 | 0.156 | CBA | 302 | 0.63 | 3.63 | 0.15 | 86 | 33 |
| 10 | 0.670 | 0.310 | 0.085 | CBA | 142 | 0.20 | 4.56 | 0.04 | — | 43 |
| 11 | 0.750 | 0.225 | 0.075 | CBA | 327 | 0.44 | 4.77 | 0.09 | 87 | 67 |
| 12 | 0.750 | 0.214 | 0.107 | CBA | 478 | 0.66 | 4.57 | 0.14 | 95 | 34 |
| 13 | 0.750 | 0.428 | 0.107 | CBA | 147 | 0.16 | 5.68 | 0.03 | 78 | 100 |
| 14 | 0.750 | 0.562 | 0.188 | CBA | 587 | 0.69 | 5.36 | 0.13 | 94 | 27 |
| 15 | 0.100 | 0.050 | 0.050 | NA | 7 | 0.08 | 0.23 | 0.35 | 74 | 133 |
| 16 | 0.150 | 0.050 | 0.050 | NA | 26 | 0.26 | 0.26 | 1.00 | 82 | 80 |
| 17 | 0.200 | 0.100 | 0.050 | NA | 21 | 0.64 | 0.22 | 2.91 | 90 | 120 |
| 18 | 0.200 | 0.100 | 0.100 | NA | 43 | 0.98 | 0.24 | 4.08 | 90 | 46 |
| 19 | 0.400 | 0.200 | 0.100 | NA | 71 | 0.42 | 1.07 | 0.39 | 94 | 52 |
| 20 | 0.600 | 0.200 | 0.100 | NA | 244 | 0.60 | 2.64 | 0.23 | 97 | 27 |
| 21 | 0.400 | 0.130 | 0.160 | BA | 116 | 0.83 | 0.83 | 0.99 | 91 | 48 |
| 22 | 0.500 | 0.200 | 0.290 | BA | 166 | 0.73 | 1.41 | 0.52 | 94 | 32 |

TABLE VI-continued

Effect of Composition on Rheology and Drain Opener Performance

| No. | CETAC wt. % | SXS wt. % | Counterion wt. % | Counterion type | Viscosity cP | Tau sec. | G0 Pa | Tau/G0 sec./Pa | Delivery % | Flow Rate mL/min |
|---|---|---|---|---|---|---|---|---|---|---|
| 23 | 0.600 | 0.240 | 0.160 | BA | 94 | 0.27 | 2.32 | 0.12 | 81 | 71 |
| 24 | 0.600 | 0.300 | 0.380 | BA | 128 | 0.36 | 2.32 | 0.16 | 93 | 34 |
| 25 | 0.600 | 0.250 | 0.150 | TA | 137 | 0.26 | 3.22 | 0.08 | 91 | 63 |
| 26 | 0.600 | 0.400 | 0.150 | TA | 46 | 0.13 | 2.20 | 0.06 | 68 | 109 |
| 27 | 0.600 | 0.400 | 0.300 | TA | 178 | 0.42 | 2.62 | 0.16 | 93 | 36 |

CETAC = Cetyltrimethylammonium Chloride
SXS = Sodium Xylenesulfonate
CBA = 4-Chlorobenzoic Acid
NA = 1-Naphthoic Acid
BA = Benzoic Acid
TA = 4-Toluic Acid
All formulas contain 5.8 wt. % sodium hypochlorite NaOCl, 4.55 wt. % Cl sodium chloride, 0.25 wt. % sodium carbonate, 1.5 wt. % sodium hydroxide and 0.113 wt. % of sodium silicate ($SiO/Na_2O$ = 3.22).

The viscoelastic compositions herein represent a substantial departure from compositions of the prior art in that elasticity, rather than simply viscosity, is the crucial parameter to the success of the invention. The viscoelastic thickener provides surprising advantages when formulated as a drain cleaner. Because the elastic components hold the solution together, it will travel through standing water with very little dilution, delivering a high percentage of active to the clog. The elasticity results in a higher delivery rate of active than a purely viscous solution of the same viscosity. This is true even if the viscosity of the solution is low. Thus, viscosity alone will not result in good performance, but elasticity alone will, and a solution which is elastic and has some viscosity will result in superior performance. Such purely viscous solutions, furthermore, do not achieve their highest delivery rates unless the viscosity is very high (above about 1000 cP). This presents other problems, including difficulty in dispensing at low temperatures, poor penetration into clogs, reduced consumer acceptance, and high cost associated with attaining such high viscosities. The elasticity also yields increased percolation times through porous or partial clogs, surprisingly increasing the effectiveness of a drain opening composition.

Table VII compares performance vs. rheology for five formulations: an un-thickened control, a sarcosinate, non-viscoelastic thickened formulation, a slightly viscoelastic formulation of a surfactant and a soap, and two viscoelastic formulations of the present invention. The delivery and flow rate parameters were measured as in Table IV.

TABLE VII

Performance Versus Rheology

| Formula | Rheology | Viscosity cP | Tau sec. | G0 Pa | Tau/G0 sec./Pa | Delivery[b] % | Flow Rate[c] mL/min |
|---|---|---|---|---|---|---|---|
| 1 | Unthickened | 1 | 0 | 0 | 0 | 0 | 2400 |
| 2 | Thickened nonelastic | 141 | 0.12 | 7.64 | 0.016 | 6 | 92 |
| 3 | Smooth | 334 | 0.35 | 6.06 | 0.058 | 47 | 52 |
| 4 | Elastic | 140 | 0.26 | 3.48 | 0.075 | 93 | 55 |
| 5 | Elastic | 153 | 0.47 | 2.11 | 0.223 | 96 | 33 |
| 6 | Smooth | 480 | 0.28 | 7.82 | 0.035 | 60 | NM[d] |
| 7 | Smooth | 187 | 0.18 | 6.61 | 0.027 | 14 | NM[d] |
| 8 | Smooth | 149 | 0.26 | 3.66 | 0.069 | 53 | NM[d] |
| 9 | Smooth | 167 | 0.12 | 7.88 | 0.015 | 1 | NM[d] |

| Formula | Wt. % | Compound | Wt. % | Compound | Wt. % | Compound |
|---|---|---|---|---|---|---|
| 1 | | | Contains no thickeners | | | |
| 2 | 1.6 | MDMAO | 0.37 | Sarcosinate[1] | 0.03 | Primacor 5980[2] |
| 3 | 0.8 | MDMAO | 0.25 | Lauric acid | — | — |
| 4 | 0.62 | CETAC | 0.09 | 4-CBA | 0.29 | SXS |
| 5 | 0.50 | CETAC | .12 | 4-CBA | 0.35 | SXS |
| 6 | 0.97 | SLS | 0.30 | Sarcosinate[1] | 0.30 | SLES |
| 7 | 0.61 | SLS | 0.38 | Sarcosinate[1] | 0.15 | SLES |
| 8 | 0.60 | SLS | 0.48 | Sarcosinate[1] | — | — |
| 9 | 0.88 | SLS | 0.98 | Sarcosinate[1] | — | — |

[b]Percentage of product that passes through standing water to the clog. 20 mL of product at 73° F. was poured into 80 mL of standing water.
[c]Rate of flow for product at 73° F. through a 3.2 cm. dia. 230 US mesh sieve.
[d]Not measured
[1]Sodium lauroyl sarcosinate
[2]A trademarked product of the Dow Chemical Co., comprising a copolymer of acrylic acid and ethylene
All formulas contain 4.5–6.0 wt. % sodium hypochlorite, 1.2–1.8 wt. % sodium hydroxide and 0.1–1.1 wt. % sodium silicate ($SiO_2/Na_2O$ = 3.22)
MDMAO = Myristyldimethylamine oxide
CETAC = Cetyltrimethyl ammonium chloride
4-CBA = 4-Chlorobenzoic acid
SXS = Sodium xylenesulfonate
SLS = Sodium lauryl sulfate
SLES = Sodium lauryl ether (3) sulfate From Table VII, it can be seen that formulas 1 and 2, which are not viscoelastic, have very low delivery values and high flow rates. This is true even though formula 2 is moderately thickened. The formulas of the above tables show that, at a Tau/G0 value of about 0.03 or greater, a preferred delivery percentage of above about 50%, more preferably above about 70%, and most preferably above about 90% is attained. Thus, relative elasticities of above about 0.03 sec/Pa are preferred, and more preferred are values of above about 0.05 sec/Pa. A most preferred relative elasticity is above about 0.07 sec./Pa. A preferred flow rate is less than about 150 mL/minute, more preferred is less than about 100 mL/minute. It can also be seen from Tables VI and VII that the relative elasticity of the composition, rather than viscosity, is crucial to drain opener performance. Comparing, for example, formulas 3 with 4 of Table VII, shows that despite having only about half the viscosity, formula 4, with a slightly higher relative elasticity, far outperformed formula 3. Formulas 15 and 17 of Table VI also show that low viscosity formulas can display good drain opening performance as long as sufficient relative elasticity is present.

It is noted that viscosities reported herein are shear viscosities, i.e. those measured by a resistance to flow perpendicular to the stress vector. However, the parameter which most accurately defines the rheology of the present invention is extensional viscosity, i.e. uniaxial resistance to flow along the stress vector. Because a means of directly measuring extensional viscosity in solutions as described herein is not yet available, the relative elasticity parameter (Tau/G0) is used as an approximation. It is noted that if a means of measuring extensional viscosity becomes available, such means could be used to further define the scope of the present invention.

The maximum benefits of the viscoelastic rheology of the drain cleaning composition of the present invention are attained when the composition is denser than water, enabling it to penetrate standing water. While less dense compositions still benefit from the viscoelastic rheology when applied to drains having porous or partial clogs, the full benefit is obtained when the composition possesses a density greater than water. In many instances, this density is attained without the need for a densifying material. In formulations containing sodium hypochlorite, for example, sufficient sodium chloride is present with the hypochlorite to afford a density greater than water. When necessary to increase the density, a salt such as sodium chloride is preferred and is added at levels of 0 to about 20%.

The cleaning active is an acid, base, solvent, oxidant, reductant, enzyme, surfactant or thioorganic compound, or mixtures thereof, suitable for opening drains. Such materials include those as previously described in the first embodiment which act by either chemically reacting with the clog material to fragment it or render it more water-soluble or dispersible, physically interacting with the clog material by, e.g., adsorption, absorption, solvation, or heating (i.e. to melt grease), or by enzymatically catalyzing a reaction to fragment or render the clog more water-soluble or dispersible. Particularly suitable are alkali metal hydroxides and hypochlorites. Combinations of the foregoing are also suitable. The drain opener may also contain various adjuncts as known in the art, including corrosion inhibitors, dyes and fragrances.

A preferred example of a drain cleaning formulation includes:

(a) an alkyl quaternary ammonium compound having at least a $C_{12}$ alkyl group;
(b) sulfonate counterion;
(c) an alkali metal hydroxide;
(d) an alkali metal silicate;
(e) an alkali metal carbonate;
(f) an alkali metal hypochlorite; and
(g) about 0.2 to about 1.0% free amine (wt. % of quaternary ammonium surfactant Another preferred example of a drain cleaning formulation includes:

(a) an alkyl quaternary ammonium compound having at least a $C_{12}$ alkyl group;
(b) mixed sulfonates and carboxylate counterions;
(c) an alkali metal hydroxide;
(d) an alkali metal silicate;
(e) an alkali metal carbonate;
(f) an alkali metal hypochlorite; and
(g) about 0.8 to about 1.8% free amine (wt. % of quaternary ammonium surfactant Components (a) and (b) in both of the above examples comprise the viscoelastic thickener and are as described previously in the first embodiment. The alkali metal hydroxide is preferably potassium or sodium hydroxide, and is present in an amount of between about 0.5 and 20% percent. The preferred alkali metal silicate is one having the formula $M_2O(SiO)_n$ where M is an alkali metal and n is between 1 and 4. Preferably M is sodium and n is 2.3. The alkali metal silicate is present in an amount of about 0 to 5 percent. The preferred alkali metal carbonate is sodium carbonate, at levels of between about 0 and 5 percent. About 1 to 10.0 percent hypochlorite is present, preferably about 4 to 8.0 percent.

In a first hard surface cleaning embodiment, a viscoelastic hypochlorite cleaning composition is provided and comprises, in aqueous solution (a) a hypochlorite bleaching species;
(b) a quaternary ammonium compound;
(c) a sulfonate counterion; and
(d) 0.2–1.0% of free amine (wt. % of quaternary ammonium surfactant.

In another hard surface cleaning embodiment, a viscoelastic hypochlorite cleaning composition is provided and comprises, in aqueous solution (a) a hypochlorite bleaching species;
(b) a quaternary ammonium compound;
(c) a mixed sulfonate and carboxylate counterion; and
(d) about 0.8–1.8 free amine (wt. % of quaternary ammonium surfactant).

The solutions are clear and transparent, and can have higher viscosities than viscoelastic solutions of the art. Because thickening is more efficient, less surfactant is needed to attain the viscosity, and chemical and physical stability of the composition is better. Less surfactant also results in a more cost-effective composition. As a hard surface cleaner, the viscoelastic rheology prevents the composition from spreading on horizontal sources and thus aids in protecting nearby bleach-sensitive surfaces. The viscoelasticity also provides the benefits of a thick system e.g. increased residence time on non-horizontal surfaces. Generally, the preferred quaternary ammonium compound for use with hypochlorite (or other source of ionic strength) is an alkyl trimethyl quaternary ammonium compound having a 12 to 18 carbon alkyl group, and most preferably the quaternary ammonium compound is CETAC. Preferably the active cleaning compound is hypochlorite, and when present, it is preferred that $R_1$, $R_2$ and $R_3$ be relatively small, and methyls are more preferred. In the presence of hypochlorite, the composition is most stable when no more than about 1.0 weight percent quaternary ammonium surfactant is present, although up to about 10 weight percent quaternary ammonium compound can be used. Substituted benzoic acids are preferred as the counterion with 4-chlorobenzoic acid being more preferred. In the presence of bleach, hydroxyl, amino, and carbonyl substituents on the counterion should be avoided. Table VIII shows hypochlorite and viscosity stability for various formulations having mixtures of counterions.

TABLE VIII

| | | | | Stability at 120° F. | | | | | | |
|---|---|---|---|---|---|---|---|---|---|---|
| | CETAC | Counterion | | Counterion | | Viscosity | % Remaining at 120° F. Viscosity | | NaOCl | |
| No. | wt. % | wt. % | Name | wt. % | Name | cP | 1 wk | 2 wk | 1 wk | 2 wk |
| 1 | 0.50 | 0.20 | BSA | 0.10 | 4-NBA | 206 | 75 | | 75 | |
| 2 | 0.50 | 0.20 | BSA | 0.20 | BA | 136 | 95 | | 75 | |
| 3 | 0.50 | 0.20 | BSA | 0.15 | SXS | 135 | 74 | | 74 | |
| 4 | 0.50 | 0.05 | 4-CBSA | 0.10 | 4-NBA | 200 | 75 | | 75 | |
| 5 | 0.50 | 0.05 | 4-CBSA | 0.10 | BA | 158 | 96 | | 74 | |
| 6 | 0.50 | 0.05 | 4-CBSA | 0.30 | BA | 205 | 94 | | 75 | |
| 7 | 0.50 | 0.05 | 4-CBSA | 0.15 | SXS | 82 | 76 | | 76 | |
| 8 | 0.30 | 0.12 | 4-CBA | 0.30 | SXS | 184 | 93 | 63 | | 60 |
| 9 | 0.40 | 0.12 | 4-CBA | 0.28 | SXS | 300 | 82 | 74 | | 60 |
| 10 | 0.52 | 0.09 | 4-CBA | 0.29 | SXS | 180 | 91 | 98 | 79 | 64 |
| 11 | 0.50 | 0.12 | 4-CBA | 0.28 | SXS | 346 | 99 | | | |
| 12 | 0.50 | 0.15 | 4-CBA | 0.35 | SXS | 413 | 93 | 67 | | 59 |
| 13 | 0.62 | 0.09 | 4-CBA | 0.29 | SXS | 235 | 85 | 85 | 76 | 60 |
| 14 | 0.72 | 0.04 | 4-CBA | 0.29 | SXS | 316 | 77 | 76 | 78 | 62 |
| 15 | 0.30 | 0.05 | NA | 0.05 | SXS | 118 | 44 | | 76 | |
| 16 | 0.30 | 0.10 | NA | 0.10 | SXS | 120 | 48 | | 76 | |
| 17 | 0.48 | 0.21 | SA | None | | 280 | 0 | | | |
| | Control | None | | None | | | | | 79 | 65 |

4-CBA = 4-Chlorobenzoic Acid
4-CBSA = 4-Chlorobenzenesulfonic Acid
SXS = Sodium Xylenesulfonate
2-CBA = 2-Chlorobenzoic Acid
BSA = Benzenesulfonic Acid
NA = Naphthoic Acid
SA = Salicylic Acid
4-NBA = 4-Nitrobenzoic Acid
BA = Benzoic Acid
All formulas contain 5.2–5.8 wt. % sodium hypochlorite, 1.6–1.8 wt. % sodium hydroxide and 4–5 wt. % sodium chloride, 0.25 wt. % sodium carbonate and 0.113 wt. % of sodium silicate ($SiO_2/Na_2O$ = 3.22).
Viscosities were measured at 72–76° F. with a Brookfield rotoviscometer model LVTD using spindle #2 at 30 rpm.

A bleach source may be selected from various hypochlorite-producing species, for example, halogen bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromo-cyanuric acid, dibromo and dichlorocyanuric acid, and potassium and sodium salts thereof, N-brominated and N-chlorinated succinimide, malonimide, phthalimide and naphthalimide. Also suitable are hydantoins, such as dibromo and dichloro dimethyl-hydantoin, chlorobromodimethyl hydantoin, N-chlorosulfamide (haloamide) and chloramine (haloamine). Particularly preferred in this invention is sodium hypochlorite having the chemical formula NaOCl, in an amount ranging from about 0.1 weight percent to about 15 weight percent, more preferably about 0.2% to 10%, and most preferably about 2.0% to 6.0%.

Advantageously, the viscoelastic thickener is not diminished by ionic strength, nor does it require ionic strength for thickening. Surprisingly, the viscoelastic compositions of the present invention are phase-stable and retain their rheology in solutions with more than about 0.5 weight percent ionizable salt, e.g., sodium chloride and sodium hypochlorite, corresponding to an ionic strength of about 0.09 g-ions/Kg solution. Surprisingly, the composition theology remained stable at levels of ionizable salt of between about 5 and 20 percent, corresponding to an ionic strength of between about 1–4 g-ions/Kg. It is expected that the viscoelastic rheology would remain even at ionic strengths of at least about 6 g-ions/Kg.

Table IX shows the effects of a salt on viscosity and phase stability for a hypochlorite containing composition of the present invention.

TABLE IX

| | Weight Percent | | | |
|---|---|---|---|---|
| Formula | 1 | 2 | 3 | 4 |
| CETAC | 0.50 | 0.50 | 0.50 | 0.50 |
| 4-Chlorobenzoic Acid | 0.13 | 0.13 | 0.13 | 0.13 |
| Sodium Xylenesulfonate | 0.32 | 0.32 | 0.32 | 0.32 |
| Sodium Hypochlorite | 5.80 | 5.80 | 5.80 | 5.80 |
| Sodium Hydroxide | 1.75 | 1.75 | 1.75 | 1.75 |
| Sodium Silicate ($SiO_2/Na_2O$ = 3.22) | 0.11 | 0.11 | 0.11 | 0.11 |
| Sodium Carbonate | 0.25 | 0.25 | 0.25 | 0.25 |
| Sodium Chloride[a] | 4.55 | 5.80 | 7.05 | 9.55 |
| Ionic Strength, g-ions,Kg | 2.42 | 2.71 | 3.00 | 3.61 |
| Viscosity[b], cP | | | | |
| 3 rpm | 600 | 680 | 820 | 1120 |
| 30 rpm | 385 | 386 | 384 | 388 |
| Number of Phases | | | | |
| 10° F. | 1C | 1C | 1 | 1 |
| 30° F. | 1 | 1 | 1 | 1 |
| 70° F. | 1 | 1 | 1 | 1 |
| 100° F. | 1 | 1 | 1 | 1 |

TABLE IX-continued

| Formula | Weight Percent 1 | 2 | 3 | 4 |
|---|---|---|---|---|
| 125° F. | 2 | 1 | 1 | 1 |

[a]Includes salt from the manufacture of sodium hypochlorite.
[b]Viscosities were measured at 72° F. with a Brookfield rotoviscometer model LVTD using spindle #2.
C = Cloudy

Optional Ingredients

Buffers and pH adjusting agents may be added to adjust or maintain Ph. Examples of buffers include the alkali metal phosphates, polyphosphates, pyrophosphates, triphosphates, tetraphosphates, silicates, metasilicates, polysilicates, carbonates, hydroxides, and mixtures of the same. Certain salts, e.g., alkaline earth phosphates, carbonates, hydroxides, etc., can also function as buffers. It may also be suitable to use as buffers such materials as aluminosilicates (zeolites), borates, aluminates and bleach-resistant organic materials, such as gluconates, succinates, maleates, and their alkali metal salts. These buffers function to keep the pH ranges of the present invention compatible with the cleaning active, depending on the embodiment. Control of pH may be necessary to maintain the stability of the cleaning active, and to maintain the counterion in anionic form. In the first instance, a cleaning active such as hypochlorite is maintained above about pH 10, preferably above or about pH 12. The counterions, on the other hand, generally don't require a pH higher than about 8 and may be as low as pH 5–6. Counterions based on strong acids may tolerate even lower pH's. The total amount of buffer including that inherently present with bleach plus any added, can vary from about 0.0% to 25%.

The composition of the present invention can be formulated to include such components as fragrances, coloring agents, whiteners, solvents, chelating agents and builders, which enhance performance, stability or aesthetic appeal of the composition. From about 0.01% to about 0.5% of a fragrance such as those commercially available from International Flavors and Fragrance, Inc. may be included in any of the compositions of the first, second or third embodiments. Dyes and pigments may be included in small amounts. Ultramarine Blue (UMB) and copper phthalocyanines are examples of widely used pigments which may be incorporated in the composition of the present invention. Suitable builders which may be optionally included comprise carbonates, phosphates and pyrophosphates, exemplified by such builders function as is known in the art to reduce the concentration of free calcium or magnesium ions in the aqueous solution. Certain of the previously mentioned buffer materials, e.g. carbonates, phosphates, phosphonates, polyacrylates and pyrophosphates also function as builders.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention while also being exemplary thereof.

What is claimed is:

1. A thickened, phase-stable cleaning composition having a viscoelastic rheology comprising, in aqueous solution (a) a hypochlorite compound, present in a cleaning effective amount;

(b) a viscoelastic thickening system present in a thickening effective amount consisting essentially of:

(i) a quaternary ammonium compound;

(ii) an organic counterion selected from the group consisting of alkyl and aryl carboxylates, alkyl and aryl sulfonates, sulfated alkyl and aryl alcohols, and mixtures thereof; and (iii) a free amine being a primary, secondary or tertiary amine and wherein the free amine is present in the composition in an amount of about 0.1–2.5% by wt. based on the quaternary ammonium compound: and wherein the resulting Composition has a relative elasticity of greater than about 0.03 sec/Pa and is phase stable and has an ionic strength of 0.09 g-ions/kg solution.

2. The thickened cleaning composition of claim 1 wherein the free amine is about 0.2–2.0% by wt. of the quaternary ammonium compound in the cleaning composition.

3. The thickened cleaning composition of claim 1 containing at least one carboxylate-containing and at least one sulfonate- or sulfate-containing counterion and wherein the free amine is about 0.8–1.8% by wt. of the quaternary ammonium compound in the cleaning composition.

4. The thickened cleaning composition of claim 1 wherein the organic counterion is selected from the group consisting of alkyl and aryl sulfonates, sulfated alkyl and aryl alcohols, and mixtures thereof and wherein the free amine is about 0.2–1.0% by wt. of the quaternary ammonium compound in the cleaning composition.

5. The thickened cleaning composition of claim 1 wherein the quaternary ammonium compound is selected from the group consisting of those having the following structures:

(a)

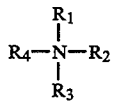

(b)

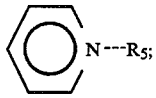

and (c) mixtures thereof;

wherein $R_1$, $R_2$ and $R_3$ are the same or different and are methyl, ethyl, propyl, isopropyl or benzyl, $R_4$ is $C_{12-18}$ alkyl, and $R_5$ is $C_{12-18}$ alkyl.

6. The composition of claim 1 wherein the composition further includes a cleaning component selected from the group consisting of acids, bases, oxidants, solvents, enzymes, detergents, thioorganic compounds, and mixtures thereof.

7. The composition of claim 1 wherein the quaternary ammonium compound is an alkyltrimethyl ammonium compound having a 14–18 carbon alkyl group, and the organic counterion is an aryl carboxylate or aryl sulfonate, or mixtures thereof.

8. The composition of claim 1 wherein component (a) is present in an amount of from about 0.05% to 50%; component (b) is present from about 0.2 to 20.0%.

9. A thickened, phase-stable viscoelastic drain opening composition comprising, in aqueous solution (a) about 0.5 to 20 percent of an alkali metal hydroxide;

(b) about 2 to 30 percent of an alkali metal hypochlorite;

(c) about 0.1 to 10 percent of a quaternary ammonium compound having the following ions (i)

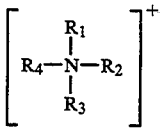

wherein $R_1$, $R_2$ and $R_3$ are the same or different and are methyl, ethyl, propyl, isopropyl or benzyl, $R_4$ is $C_{12-18}$ alkyl; and (ii) about 0.01 to 10 percent of an organic counterion, selected from the group consisting of alkyl and aryl carboxylates, alkyl and aryl sulfonates, and sulfate alkyl and aryl alcohols and mixtures thereof; wherein there is from 0.1 to about 2.5 wt. percent free amine present in the composition based on the quaternary ammonium compound; and wherein the resulting composition has a relative elasticity of greater than about 0.03 sec/Pa, a density greater than that of water, a viscosity of at least about 20 cP, and is phase-stable.

10. The thickened viscoelastic drain opening composition of claim 9 further including about 0 to about 5 weight percent of an alkali metal silicate, and about 0 to about 5 weight percent of an alkali metal carbonate.

11. A thickened viscoelastic phase-stable hypochlorite composition comprising, in aqueous solution (a) a hypochlorite-producing source, present in an amount sufficient to produce a bleaching-effective amount of hypochlorite; and (b) thickening-effective amount of a viscoelastic thickening system comprising a quaternary ammonium ions, selected from the group consisting of:

(i)

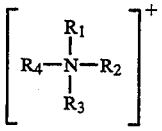

(ii)

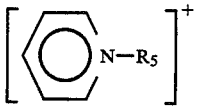

and (iii) mixtures thereof;

wherein $R_1$, $R_2$ and $R_3$ are the same or different and are methyl, ethyl, propyl, isopropyl or benzyl, $R_4$ is $C_{14-18}$ alkyl, and $R_5$ is $C_{14-18}$ alkyl; and an organic counterion selected from the group consisting of a sulfonate or sulfate, $C_{2-10}$ alkyl carboxylates, aryl carboxylates, $C_{2-10}$ alkyl alcohols, and mixtures thereof; and wherein the composition is phase stable, has a relative elasticity of greater than about 0.03 sec/Pa, and a viscosity of at least about 20 cP, and there is from 0.1 to about 2.5 wt. percent free amine present in the composition based on the quaternary ammonium compound.

12. The composition of claim 11 wherein component (a) is present from about 0.1 to 15 wt. percent; and compound (b) is present from about 0.11 to 20 wt. percent; compound (c) is present from about 0.01 to 10 wt. percent and a mole ratio of the quaternary ammonium compound to the organic counterion is between about 12:1 and 1:6.

* * * * *